US006860735B1

(12) United States Patent
Shimono

(10) Patent No.: US 6,860,735 B1
(45) Date of Patent: Mar. 1, 2005

(54) ROTARY KILN

(75) Inventor: Masanobu Shimono, Kobe (JP)

(73) Assignee: S. Mac Co., Ltd., Kobe (JP)

( * ) Notice: Subject to any disclaimer, the term of this patent is extended or adjusted under 35 U.S.C. 154(b) by 0 days.

(21) Appl. No.: 10/381,137

(22) PCT Filed: Sep. 21, 2000

(86) PCT No.: PCT/JP00/06482

§ 371 (c)(1),
(2), (4) Date: Mar. 21, 2003

(87) PCT Pub. No.: WO02/25195

PCT Pub. Date: Mar. 28, 2002

(51) Int. Cl.[7] ..... F27B 7/14

(52) U.S. Cl. ..... 432/118; 432/103; 432/108; 34/201; 34/219

(58) Field of Search ..... 432/108, 109, 432/110, 118, 103, 106; 34/201, 202, 205, 219; 241/181, 183

(56) References Cited

U.S. PATENT DOCUMENTS 2,971,265 A * 2/1961 Young ..... 34/137
4,600,379 A * 7/1986 Elliott ..... 432/13
5,522,158 A 6/1996 Swanson
5,538,340 A * 7/1996 Brashears ..... 366/25
5,906,483 A * 5/1999 Zhou ..... 432/112
6,363,625 B1 * 4/2002 Niemi ..... 34/136

FOREIGN PATENT DOCUMENTS

| | | |
|---|---|---|
| JP | 45-29726 | 9/1945 |
| JP | 58-9181 | 1/1958 |
| JP | 9-506964 | 7/1997 |

* cited by examiner

*Primary Examiner*—Gregory Wilson
(74) *Attorney, Agent, or Firm*—Ronald E. Greigg

(57) ABSTRACT

Disclosed is a rotary kiln that can be used efficiently in drying, dry distillation and incineration of various garbage and industrial wastes.

The rotary kiln comprises a cylindrical furnace body (10) disposed to incline at a small angle from the horizontal plane, a cylindrical contact heater (20) supported in the furnace body (10), a rotation drive means (30) that drives the furnace body (10) and the contact heater (20) to rotate, a waste charging port (61), a processed material discharging port (18), a combustion gas supply means (40) that supplies a combustion gas into the cylindrical contact heater (20) and a combustion gas introducing means (50) that guides the combustion gas through the contact heater (20) from a distal end to a proximate end thereof, and then guides the combustion gas through a space (S) between the contact heater (20) and the furnace body (10) from the proximate end to the distal end, thereby to charge.

8 Claims, 3 Drawing Sheets

ROTARY KILN

CROSS-REFERENCE TO RELATED APPLICATIONS

This application is a 35 USC 371 application of PCT/JP00/06482 filed on Sep. 21, 2000.

BACKGROUND OF THE INVENTION

1. Field of the Invention

The present invention relates to a rotary kiln which can be preferably used as a pretreatment furnace, and a drying furnace or dry distillation furnace for drying or dry distillation of kitchen garbage that includes much water content. The rotary kiln can also be used as a recombustion furnace that burns unburned components included in incineration ash.

2. Description of the Prior Art

Various rotary kilns comprising a rotatable cylindrical furnace body have been provided. Most of these rotary kilns are operated by simply rotating the cylindrical furnace body so as to move the waste through the inside of the furnace from one end to the other end, during which the waste is dried or burned and discharged. In a version of rotary kiln that utilizes a high-temperature gas, a common practice is that the high-temperature gas is introduced from the end of the furnace body in a counter flow against the movement of the waste, so as to dry or burn the waste by means of the high-temperature gas.

Also there is such a rotary kiln that utilizes high-temperature gas that has a baffle plate disposed in the furnace thereby improving the effect of contact between the waste and the high-temperature gas.

An object of the present invention is to provide a rotary kiln capable of processing wastes with a higher heat efficiency.

SUMMARY OF THE INVENTION

The rotary kiln according a first aspect of the present invention, in order to achieve the object described above, comprises a cylindrical furnace body disposed to incline at a small angle from the horizontal plane, a cylindrical contact heater supported in the furnace body along the longitudinal direction thereof, a rotation drive means that drives the furnace body and the contact heater to rotate around the center axis of the cylinder, a waste charging port through which the waste is charged into the furnace at a proximate end thereof, a discharging port provided at the distal end for discharging the processed material that has been moved from the charging port, a combustion gas supply means that supplies a combustion gas into the cylindrical contact heater at the distal end thereof and a combustion gas introducing means that guides the combustion gas, that has been supplied from the combustion gas supply means, through the contact heater from the distal end to the proximate end thereof, and then guides the combustion gas, that has been released from the proximate end into the furnace body, through a space formed between the contact heater and the furnace body from the proximate end to the distal end of the furnace body, thereby to discharge the combustion gas through the distal end of the furnace body to the outside.

According to the first aspect of the present invention described above, the furnace body and the contact heater that is supported in the furnace body are driven to rotate by the rotation drive means. The waste charged into the furnace body at the proximate end thereof moves through the furnace body, that is inclined at a small angle from the horizontal plane, from the proximate end to the distal end while repeating a cycle of being raised and dropped off along the inner surface of the furnace body as the furnace body rotates. Meanwhile the combustion gas, that has been supplied from the combustion gas supply means into the cylindrical contact heater at the distal end thereof, heats the contact heater to a high temperature while passing through the contact heater from the distal end to the proximate end thereof. When coming out of the contact heater, the combustion gas U-turns and flows through the space between the contact heater and the furnace body from the proximate end toward the distal end while making contact with the waste, before being discharged from the discharging port.

The waste is heated not only by the inner surface of the furnace body, but also by the combustion gas and through contact with the outer surface of the contact heater, while moving through the furnace body. The waste is dried, experiences dry distillation (in case the atmosphere is made deplete of air), or burned, depending on the combustion gas temperature.

The rotation drive means can be constituted from a rotation drive machine such as a motor, a speed reducer, a transmission chain, or the like, so as to drive the furnace body and the contact heater either together or separately.

The combustion gas supply means can be constituted from a burner, a supply tube for supplying the combustion gas generated by a burner into the contact heater, or other suitable means.

The combustion gas guiding means can include a fan that generates a negative pressure for introducing the gas, and/or air flow regulating means such as damper, or the like.

According to the first aspect with the constitution described above, since the contact heater is installed in the furnace body and the combustion gas is brought into sufficient contact with the waste while flowing through the contact heater and making a U turn, the waste is dried not only through contact with the combustion gas, but also through contact with the contact heater that has been heated sufficiently, thus capable of very efficient drying, dry distillation and/or incineration.

In addition to the constitution of the first aspect described above, a rotary kiln according to a second aspect of the present invention is provided with rake up means installed on the inner surface of the furnace body that rakes up the waste, that has been charged into the furnace body, along the circumferential direction of the cylinder as the furnace body rotates.

According to the second aspect described above, in addition to the operation and effects of the first aspect, the waste that has been charged into the furnace body is raked up to a position sufficiently high by the rake up means installed on the inner surface of the furnace body and then falls off by gravity, as the furnace body rotates. When falling, the waste rests on the contact heater so as to make contact with the outer surface of the contact heater and is heated further. As the contact heater rotates, the waste is caused to fall bit by bit at different positions, so as to fall again separately onto the inner surface of the furnace body. The waste repeats this cycle until it is discharged out of the furnace body.

Thus according to the second aspect of the present invention, the waste can be brought into contact with the combustion gas with a higher efficiency by sufficiently stirring the waste in the furnace body, and the waste can be brought into contact with the contact heater with a high efficiency, making it possible to carry out drying, dry distillation and incineration with high efficiency.

In addition to the constitutions of the first and second aspects described above, a rotary kiln according to the third aspect of the present invention is provided with slip preventing means installed on the inner surface of the furnace body that prevents the waste charged into the furnace body from slipping and moving too fast toward the distal end.

According to the third aspect described above, in addition to the operations and effects of the first and second aspect, such an effect is achieved as the waste charged into the furnace body is prevented, by the slip preventing means installed on the inner surface of the furnace body, from slipping and moving too fast toward the distal end. While too fast a movement of the waste may cause the waste to be discharged without being sufficiently heated for drying, dry distillation or incineration, installing the slip preventing means enables it to move the waste through the furnace body with a predetermined proper retention time.

In addition to any one of the constitutions of the first to third aspects described above, a rotary kiln according to a fourth aspect of the present invention is provided with one or a plurality of vanes disposed around the circumference of the cylindrical contact heater extending radially therefrom, so that the waste that falls off after being raised along the inner surface of the furnace body as the furnace body rotates, on the vane so as to promote contact heating and, at the same time, the waste falls from the vane onto the inner surface of the furnace body again in a scattered state.

According to the fourth aspect described above, in addition to the operations and effects of any one of the first to third aspects, such an effect is achieved as the area of contact with the waste is increased by making such a configuration of the contact heater installed in the furnace body as the vane is installed around the circumference of the cylindrical contact heater extending radially therefrom, thereby increasing the area of contact with the waste and conveniently receiving the waste falling off from near the top in the furnace body, thus making it possible to efficiently process the waste including drying, dry distillation and recombustion of the unburned material included in the incineration ash. Also because the waste falls while being dispersed onto different positions of the inner surface of the furnace body depending on the angular position of the vane as the contact heater rotates, the waste can be prevented from being concentrated thereby ensuring proper processing performance.

BRIEF DESCRIPTION OF THE DRAWINGS

The foregoing and other features and advantages of the invention will become apparent from the detailed description contained herein below, taken in conjunction with the drawings, in which.

DESCRIPTION OF THE PREFERRED EMBODIMENTS

An example of preferred rotary kiln according to the present invention will be described below with reference to FIG. 1 to FIG. 3.

Figure 1:
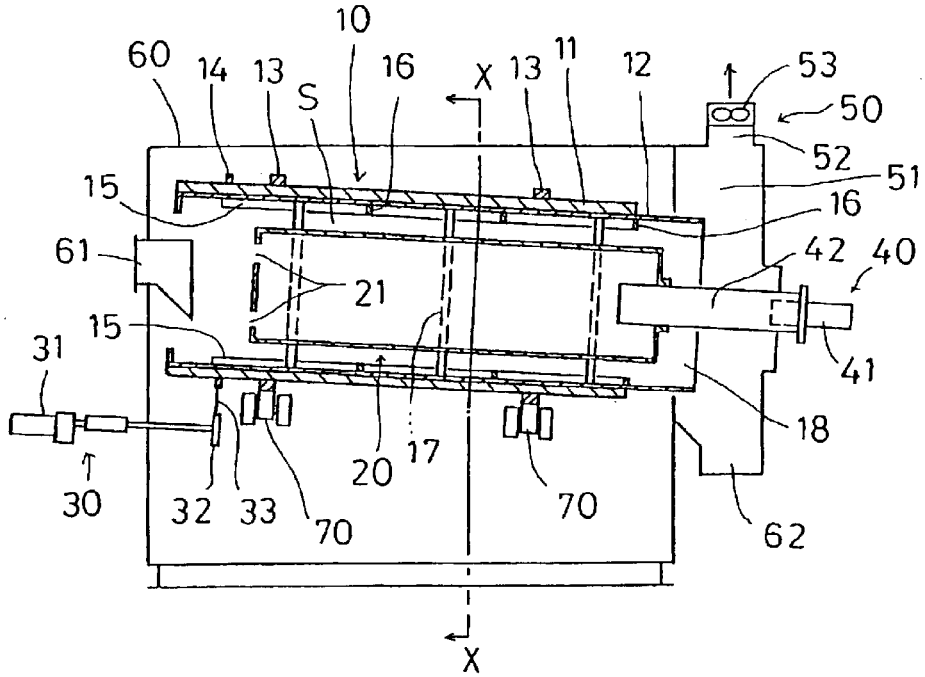
FIG. 1 is a longitudinal sectional view of an example of a preferred rotary kiln according to the present invention.
Figure 2:
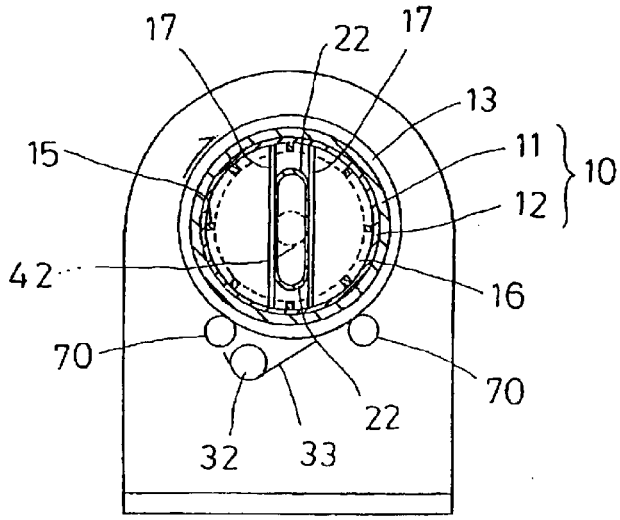
FIG. 2 is a sectional view taken along lines X—X of FIG. 1.
Figure 3:
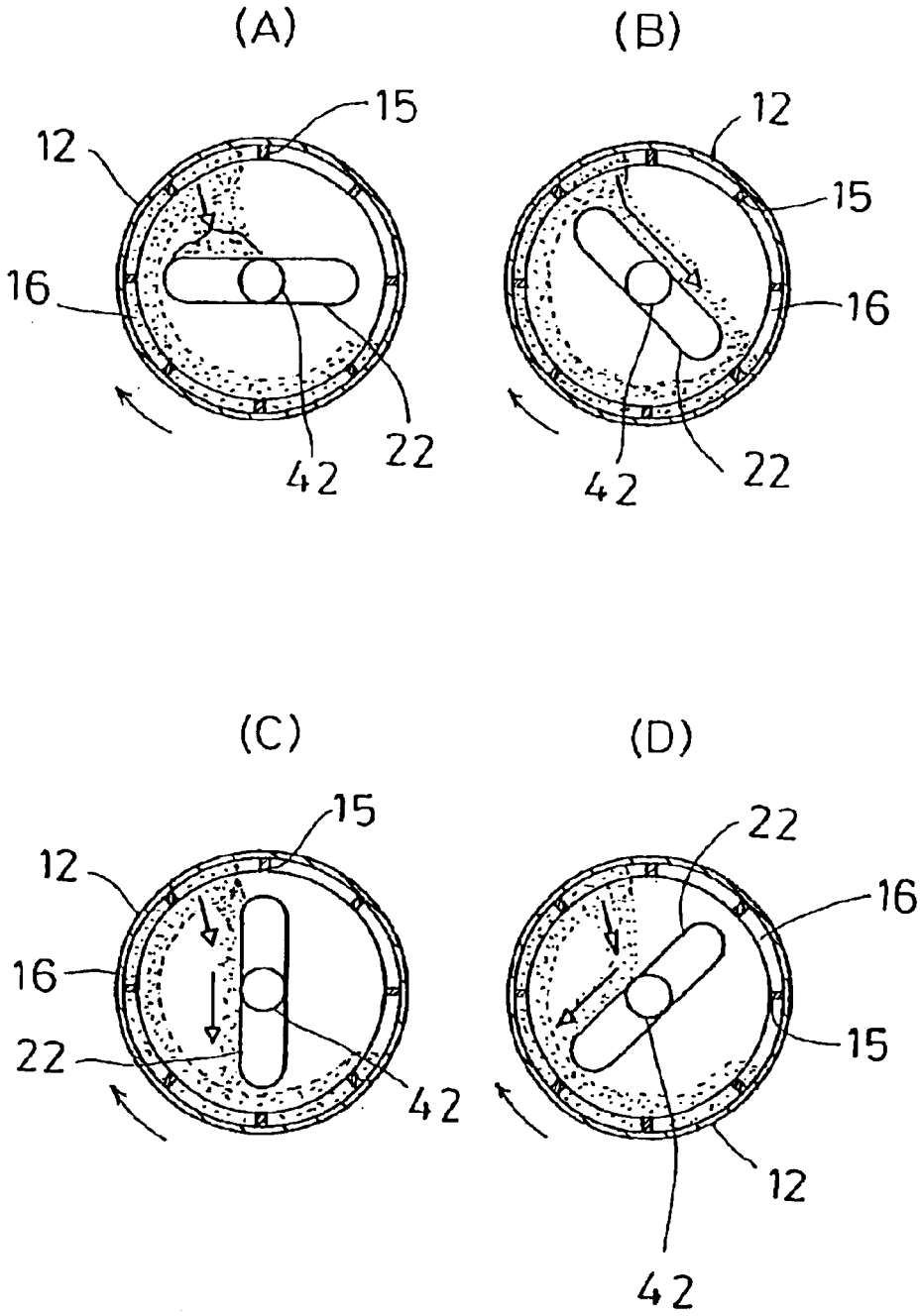
FIGS. 3(A), 3(B), 3(C) and 3(D) show different angular positions of the rotating contact heater and the direction of the waste falling off.

The rotary kiln shown in FIG. 1 to FIG. 3 is made in a horizontal configuration. The rotary kiln comprises a furnace body 10, a contact heater 20 that is supported in the furnace body 10 along the longitudinal direction thereof, a rotation drive means 30 that drives the furnace body 10 and the contact heater 20 to rotate, a combustion gas supply means 40 that supplies a combustion gas into the contact heater 20, a combustion gas guiding means 50 that guides the combustion gas that has been supplied into the contact heater and the furnace body 10, and an outer casing 60.

The furnace body 10 has a cylindrical shape and is supported by a pair of support roll assemblies 70 so as to be inclined at a small angle from the horizontal plane. The furnace body 10 is driven by the rotation drive means 30 to rotate around the center axis of the cylinder. Accordingly, the waste that is charged into the furnace body 10 at the proximate end thereof through the charging port 61 moves toward the distal end while repeating a cycle of being raised and falling off as the furnace body 10 rotates.

The furnace body 10 is constituted from a heat resistant cylinder consisting of an outer cylinder 11 and an inner cylinder 12, and is provided with ring rails 13 that facilitate rotation on the support rolls 70 and a sprocket 14 for transmitting the rotation drive force of the rotation drive means 30.

The inner cylinder 12 has, on the inner surface thereof, a plurality of (in the example shown, eight) rake-up ridges 15 disposed at constant intervals along the circumference, running in the longitudinal direction of the cylinder. The rake-up ridges 15 are provided for raising the waste that is charged into the furnace body 10 efficiently along the circumference as the furnace body 10 rotates, and rake up the waste along the circumference as the furnace body 10 rotates.

The inner cylinder 12 has, on the inner surface thereof, a plurality of (in the example shown, three) ring-shaped slip preventing ridges 16 disposed at constant intervals in the longitudinal direction of the cylinder running along the circumference. The ring-shaped slip preventing ridges 16 prevent the waste that is charged into the furnace body 10 from slipping toward the distal end.

The contact heater 20 heats up the waste through contact therewith, and also scatters the waste in the furnace body 10 so that the waste will not be concentrated.

The contact heater 20 has a generally cylindrical configuration so as to allow the combustion gas to pass therethrough from the distal end to the proximate end thereof. As the combustion gas passes the inside, the contact heater 20 is heated to a high temperature. The combustion gas that has passed the contact heater 20 is discharged through outlet 21 provided at the proximate end of the contact heater 20 into the furnace body 10.

The contact heater 20 is fixed onto the furnace body 10 (at three points in this example) by means of support 17. The contact heater 20 is supported concentrically in the cylindrical furnace body 10, and rotates around the center axis together with the furnace body 10.

The contact heater 20 has vanes 22 disposed around the circumference thereof extending radially therefrom. Installing the vanes 22 increases the chance of making contact with the waste, and also makes it possible to heat the waste that falls off after being raised in the furnace body 10 as it rotates, by receiving the waste on the vanes so as to promote contact heating and let the waste fall in a scattered state.

Figure 4:
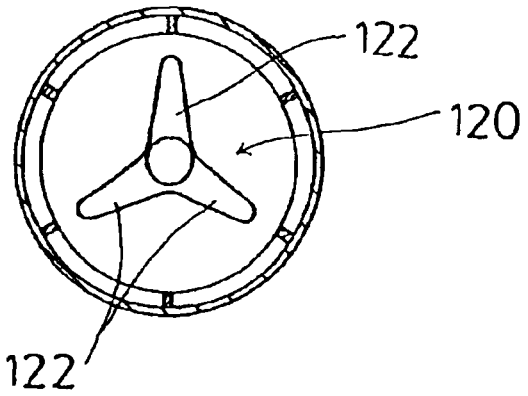
FIG. 4 is a sectional view showing another example of the contact heater.
Figure 5:
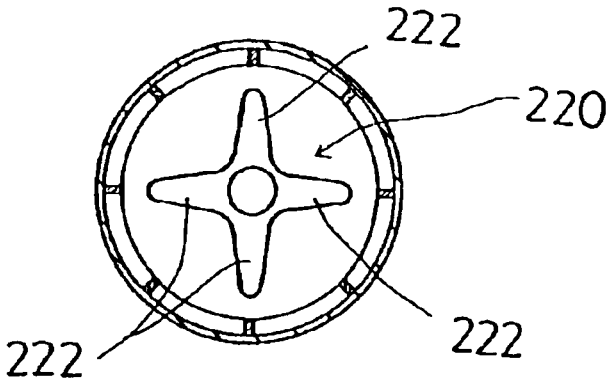
FIG. 5 is a sectional view showing a further example of the contact heater.

In the example shown in FIG. 1 to FIG. 3, a pair of the vanes 22 are disposed on the circumference, so that the contact heater 20 has a flattened cylinder shape overall. The number of the contact vanes 22 provided on the contact heater 20 may not be necessarily be two. The contact heater may have the form of a contact heater 120 that has three vanes 122 disposed around the circumference thereof extending radially therefrom as shown in FIG. 4. Also the contact heater may have the form of a contact heater 220 that has four vanes 222, as shown in FIG. 5. There is no restriction on the number of the vanes.

The rotation drive means 30 has a motor 31 with a speed reducer, a sprocket 32 and a transmission chain 33, so that as the motor 31 runs, the furnace body 10 is driven to rotate via the sprocket 32, the transmission chain 33 and the sprocket 14 of the furnace body 10. As the furnace body 10 rotates, the contact heater 20 also rotates therewith.

The combustion gas supply means 40 has a burner 41 such as gas burner or petroleum burner, and a supply tube 42 that supplies the combustion gas generated in the burner 41 into the contact heater 20 has its tip extending into the contact heater 20 through the distal end thereof. The joint of the supply tube 42 and the contact heater 20 is sealed so as not to allow the gas to leak.

The combustion gas guiding means 50 comprises an exhaust gas collection chamber 51 that is a space immediately following the discharge port 18 opening at the distal end of the furnace body 10, installed adjacent to the outer casing 60, an exhaust gas discharge port 52 installed in the ceiling of the exhaust gas collection chamber 51, and an exhaust fan 53 that forcibly extracts the exhaust gas.

When the exhaust fan 53 runs, the combustion gas supplied from the burner 41 through the supply tube 42 into the contact heater 20 is guided to flow through the contact heater 20 from the distal end to the proximate end thereof, while heating the contact heater 20. The combustion gas then exits from the contact heater 20 through the gas outlet 21 provided at the proximate end thereof so as to enter the furnace body 10, and flows through the space S between the contact heater 20 and the furnace body 10 toward the distal end of the furnace body 10. The combustion gas makes contact with the waste in this process. The combustion gas flowing through the space S toward the distal end exits the furnace body through the exhaust port 18 of the furnace body 10 and enters the exhaust gas collection chamber 51, from which it is discharged through the exhaust port 52 to the outside of the apparatus.

The outer casing 60 shields the furnace body 10 and other components that reach a high temperature, and has a charging port 61 for the waste. Under the exhaust gas collection chamber 51 that may be a part of the outer casing 60, a takeout port 62 is provided for removing the waste that has been discharged from discharging port 18 of the furnace body 10, out of the apparatus. The waste charged through the charging port 61 into the furnace body 10 moves from the proximate end to the distal end while repeating the cycle of being raised and falling as the furnace body 10 rotates.

A description will be given below for the operation of processing the waste in the rotary kiln of the present invention having the constitution described above.

In case the rotary kiln of the present invention is used for drying waste such as kitchen garbage that includes much water content prior to incineration, temperature of the combustion gas delivered from the burner 41 is set to a temperature appropriate for drying the waste such as kitchen garbage that includes much water. The speed of moving the waste through the furnace body is also optimized. In case the rotary kiln of the present invention is used for dry distillation of city garbage and industrial waste, temperature and oxygen concentration of the combustion gas are set to appropriate values. In case the rotary kiln of the present invention is used for recombustion of unburned components included in incineration ash, temperature of the combustion gas and the combustion air concentration are controlled accordingly.

Now the operation will be described with reference to FIG. 3, in case waste is charged through the charging port 61 into the furnace body 10 that is rotating, while combustion gas supplied from the burner 41 is introduced into the contact heater 20. The waste that has been charged moves from the proximate end to the distal end while repeating the cycle of being raised by the rake-up ridges 15 to a high position on the inner surface of the furnace body 10 and falling off as the furnace body 10 rotates. During this process, the contact heater 20 also rotates and the position of the vanes 22 around the axis as shown in FIGS. 3(A) to FIG. 3(D) depending on the angular phase of rotation. When the vane 22 is at the position (A), the vane receives the falling waste and carries it to position (B) while heating the waste through contact therewith. At position (B), the waste slips down along the inclined vane in the direction indicated by an arrow. When the vane 22 receives the falling waste at position (C), the vane lets the waste fall right downward as indicated by an arrow while heating the waste through contact therewith. When the vane 22 is at the position (D), the falling waste is heated while slipping down along the inclined vane in the direction indicated by an arrow. Thus the contact heater 20 heats the waste through contact therewith while rotating, and also scatters the waste so as to prevent the waste from being concentrated.

The waste is also heated through contact with the combustion gas and through contact with the inner surface of the furnace body 10 while moving through the furnace body 10.

INDUSTRIAL APPLICABILITY

As described above, the rotary kiln according to the present invention can be preferably used as a pretreatment furnace for incinerating city garbage including kitchen garbage and a drying furnace or dry distillation furnace for drying or dry distillation of kitchen garbage that includes much water. The rotary kiln can also be used as a recombustion furnace that burns unburned components included in incineration ash. The rotary kiln can be used as an efficient apparatus for drying, dry distillation and incineration of various garbage and industrial wastes by changing the combustion gas temperature and the quantity of oxygen supply according to the mode of processing the waste.

The foregoing relates to preferred exemplary embodiments in the invention, it being understood that other variants and embodiments thereof are possible within the spirit and scope of the invention, the latter being defined by the appended claims.

I claim:

1. A rotary kiln comprising a cylindrical furnace body 10 disposed to incline at a small angle from the horizontal plane, a cylindrical contact heater 20 supported in said furnace body 10 along the longitudinal direction thereof, a rotation drive means 30 that drives said furnace body 10 and said contact heater 20 to rotate around the center axis thereof, a waste charging port 61 for charging the waste into the furnace body at the proximate end thereof, a discharging port 18 for discharging processed material that has moved from the charging port 61 at the distal end of said furnace body 10, a combustion gas supply means 40 that supplies a combustion gas into said cylindrical contact heater 20 at the distal end, a combustion gas guiding means 50 that guides the combustion gas supplied from said combustion gas supply means 40 through said contact heater 20 from the distal end to the proximate end and then guides the combustion gas that has been released from the proximate end into the furnace body 10 through a space S between said contact heater 20 and said furnace body 10 from the proximate end to the distal end, thereby to discharge the gas from the furnace body 10 at the distal end thereof to the outside.

2. The rotary kiln according to claim 1, wherein said furnace body 10 further comprising rake up means 15 on the inner surface thereof for raising the waste that has been charged therein along the circumference as the furnace body 10 rotates.

3. The rotary kiln according to claim 2, wherein said contact heater 20 has at least one vane 22 disposed around the center axis thereof extending radially therefrom, said at least one vane 22 receiving waste that falls off after being raised along the inner circumference of the furnace body 10 as the furnace body 10 rotates so as to promote contact heating and let the waste fall off from said at least one vane 22 onto the inner surface of the furnace body 10 again in a scattered state.

4. The rotary kiln according to claim 1, wherein said furnace body 10 comprises on the inner surface thereof, slip preventing ridges 16 for preventing waste that has been charged into said furnace body 10, from slipping and moving toward the distal end.

5. The rotary kiln according to claim 4, wherein said contact heater 20 has at least one vane 22 disposed around the center axis thereof extending radially therefrom, said at least one vane 22 receiving waste that falls off after being raised along the inner circumference of the furnace body 10 as the furnace body 10 rotates so as to promote contact heating and let the waste fall off from said at least one vane 22 onto the inner surface of the furnace body 10 again in a scattered state.

6. A rotary kiln comprising, a cylindrical furnace body 10 disposed to incline at a small angle from the horizontal plane, a cylindrical contact heater 20 supported in said furnace body 10 along the longitudinal direction thereof, a rotation drive means 30 that drives said furnace body 10 and said contact heater 20 to rotate around the center axis thereof, a waste charging port 61 for charging the waste into the furnace body at the proximate end thereof, a discharging port 18 for discharging processed material that has moved from the charging port 61 at the distal end of said furnace body 10, a combustion gas supply means 40 that supplies a combustion gas into said cylindrical contact heater 20 at the distal end, a combustion gas guiding means 50 that guides the combustion gas supplied from said combustion gas supply means 40 through said contact heater 20 from the distal end to the proximate end and then guides the combustion gas that has been released from the proximate end into the furnace body 10 through a space S between said contact heater 20 and said furnace body 10 from the proximate end to the distal end, thereby to discharge the gas from the furnace body 10 at the distal end thereof to the outside;

wherein said furnace body 10 further comprising rake up means 15 on the inner surface thereof for raising the waste that has been charged therein along the circumference as the furnace body 10 rotates; and wherein said furnace body 10 comprises on the inner surface thereof, slip preventing ridges 16 for preventing waste that has been charged into said furnace body 10, from slipping and moving toward the distal end.

7. The rotary kiln according to claim 6, wherein said contact heater 20 has at least one vane 22 disposed around the center axis thereof extending radially therefrom, said at least one vane 22 receiving waste that falls off after being raised along the inner circumstance of the furnace body 10 as the furnace body 10 rotates so as to promote contact heating and let the waste fall off from said at least one vane 22 onto the inner surface of the furnace body 10 again in a scattered state.

8. A rotary kiln according comprising, a cylindrical furnace body 10 disposed to incline at a small angle from the horizontal plane, a cylindrical contact heater 20 supported in said furnace body 10 along the longitudinal direction thereof, a rotation drive means 30 that drives said furnace body 10 and said contact heater 20 to rotate around the center axis thereof, a waste charging port 61 for charging the waste into the furnace body at the proximate end thereof, a discharging port 18 for discharging processed material that has moved from the charging port 61 at the distal end of said furnace body 10, a combustion gas supply means 40 that supplies a combustion gas into said cylindrical contact heater 20 at the distal end, a combustion gas guiding means 50 that guides the combustion gas supplied from said combustion gas supply means 40 through said contact heater 20 from the distal end to the proximate end and then guides the combustion gas that has been released from the proximate end into the furnace body 10 through a space S between said contact heater 20 and said furnace body 10 from the proximate end to the distal end, thereby to discharge the gas from the furnace body 10 at the distal end thereof to the outside; and wherein said contact heater 20 has at least one vane 22 disposed around the center axis thereof extending radially therefrom, said at least one vane 22 receiving waste that falls off after being raised along the inner circumference of the furnace body 10 as the furnace body 10 rotates so as to promote contact heating and let the waste fall off from said at least on vane 22 onto the inner surface of the furnace body 10 again in a scattered state.

* * * * *